US007887044B2

(12) United States Patent
Uchino et al.

(10) Patent No.: US 7,887,044 B2
(45) Date of Patent: Feb. 15, 2011

(54) SHEET CONVEYING DEVICE AND IMAGE RECORDING APPARATUS COMPRISING SHEET CONVEYING DEVICE

(75) Inventors: Yuta Uchino, Nagoya (JP); Takashi Ohama, Iwakura (JP); Naokazu Tanahashi, Nagoya (JP); Wataru Sugiyama, Aichi-ken (JP); Noriyuki Kawamata, Nagoya (JP); Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/569,666

(22) Filed: Sep. 29, 2009

(65) Prior Publication Data

US 2010/0078871 A1 Apr. 1, 2010

(30) Foreign Application Priority Data

Sep. 29, 2008 (JP) ..... 2008-251121

(51) Int. Cl.
*B65H 3/52* (2006.01)

(52) U.S. Cl. ..... 271/121; 271/123; 271/186; 271/225; 271/253; 271/902; 271/3.08

(58) Field of Classification Search ..... None
See application file for complete search history.

(56) References Cited

U.S. PATENT DOCUMENTS

| | | | | |
|---|---|---|---|---|
| 4,379,549 | A * | 4/1983 | Mizuma | 271/3.02 |
| 5,052,676 | A * | 10/1991 | Shiina et al. | 271/121 |
| 5,120,042 | A * | 6/1992 | Goto et al. | 271/117 |
| 5,791,645 | A * | 8/1998 | Takada | 271/3.03 |
| 6,126,347 | A | 10/2000 | Sakaino et al. | |
| 2002/0093134 | A1 | 7/2002 | Minakawa | |
| 2009/0026685 | A1 * | 1/2009 | Uchino et al. | 270/18 |

(Continued)

FOREIGN PATENT DOCUMENTS

JP SHO 61-092642 U 6/1986

(Continued)

OTHER PUBLICATIONS

Japan Patent Office; Notice of Reasons for Rejection in Japanese Patent Application No. 2008-251121 (counterpart to the above-captioned US Patent Application) mailed on Aug. 3, 2010.

*Primary Examiner*—Stefanos Karmis
*Assistant Examiner*—Gerald W McClain
(74) *Attorney, Agent, or Firm*—Baker Botts L.L.P.

(57) ABSTRACT

A sheet conveying device includes a feed tray including a bottom plate configured to hold a sheet, a feed roller configured to feed the sheet in a first direction from the feed tray to a first conveying path, and a pressing member configured to press the sheet in the feed tray against the bottom plate of the feed tray. The pressing member includes a contact portion configured to contact the sheet in the feed tray, and a first guide positioned at a downstream end of the pressing member in the first direction. The first guide extends between the downstream end and the contact portion obliquely with respect to the bottom plate, such that a distance between the bottom plate and the first guide increases along the first direction. The first guide is positioned upstream of the feed roller in the first direction.

12 Claims, 11 Drawing Sheets

U.S. PATENT DOCUMENTS

| | | | |
|---|---|---|---|
| 2009/0218754 | A1 | 9/2009 | Wataru et al. |

FOREIGN PATENT DOCUMENTS

| | | | | |
|---|---|---|---|---|
| JP | 03162340 | A | * | 7/1991 |
| JP | H04-182234 | A | | 6/1992 |
| JP | 05058562 | A | * | 3/1993 |
| JP | H10-007292 | A | | 1/1998 |
| JP | H10-035928 | A | | 2/1998 |
| JP | H11-255364 | A | | 9/1999 |
| JP | 2002-274701 | A | | 9/2002 |
| JP | 2004-331255 | A | | 11/2004 |
| JP | 2007-070069 | A | | 3/2007 |
| WO | 9858863 | A1 | | 12/1998 |

* cited by examiner

SHEET CONVEYING DEVICE AND IMAGE RECORDING APPARATUS COMPRISING SHEET CONVEYING DEVICE

CROSS REFERENCE TO RELATED APPLICATION

This application claims priority from Japanese Patent Application No. 2008-251121, which was filed on Sep. 29, 2007, the disclosure of which is incorporated herein by reference in its entirety.

BACKGROUND OF THE INVENTION

1. Field of the Invention

This application relates to a sheet conveying device that feeds a recording medium, e.g., a sheet, along a conveying path while reducing the occurrence of skewing of the sheet, and relates to an image recording apparatus comprising such a sheet conveying device.

2. Description of Related Art

A known sheet conveying device comprises a feed roller, a feed tray, and a pressing member. The feed roller feeds an uppermost one of sheets from the feed tray while the pressing member presses the uppermost sheet in the tray. This may prevent skewing of the sheet being fed.

A known sheet conveying device used for an image recording apparatus employs a so-called reverse registration in order to correct skewing of a sheet before recording an image on the sheet. The sheet fed by a feed roller from a feed tray and reaching the pair of convey rollers is conveyed back to the feed tray by a predetermined distance in order to align a leading edge of the sheet with respect to the pair of convey rollers.

When a sheet is conveyed back to a feed tray, for the purpose of such reverse registration or other reasons, in a sheet conveying device comprising a member for pressing a sheet in the feed tray, a trailing edge of the sheet conveyed back to the feed tray may collide with the pressing member, resulting in skewing or jamming of the sheet.

SUMMARY OF THE INVENTION

Therefore, a need has arisen for a sheet conveying device and an image recording apparatus that overcome these and other shortcomings of the related art.

According to an embodiment of the invention, a sheet conveying device comprises a feed tray comprising a bottom plate configured to hold a sheet, a feed roller configured to feed the sheet in a first direction from the feed tray to a first conveying path, and a pressing member configured to press the sheet in the feed tray against the bottom plate of the feed tray. The pressing member comprises a contact portion configured to contact the sheet in the feed tray, and a first guide positioned at a downstream end of the pressing member in the first direction. The first guide extends between the downstream end and the contact portion obliquely with respect to the bottom plate, such that a distance between the bottom plate and the first guide increases along the first direction. The first guide is positioned upstream of the feed roller in the first direction.

According to another embodiment of the invention, an image recording apparatus comprises a sheet conveying device comprising a sheet conveying device and a recording unit. The sheet conveying device comprises a feed tray comprising a bottom plate configured to hold a sheet, a feed roller configured to feed the sheet in a first direction from the feed tray to a first conveying path, and a pressing member configured to press the sheet in the feed tray against the bottom plate of the feed tray. The pressing member comprises a contact portion configured to contact the sheet in the feed tray, and a first guide positioned at a downstream end of the pressing member in the first direction. The first guide extends between the downstream end and the contact portion obliquely with respect to the bottom plate, such that a distance between the bottom plate and the first guide increases along the first direction. The first guide is positioned upstream of the feed roller in the first direction. The recording unit is disposed along the first conveying path and configured to record an image onto the sheet being conveyed along the first conveying path.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

For a more complete understanding of the invention, the needs satisfied thereby, and the features and technical advantages thereof, reference now is made of the following descriptions taken in connection with the accompanying drawings.

Figure 1:
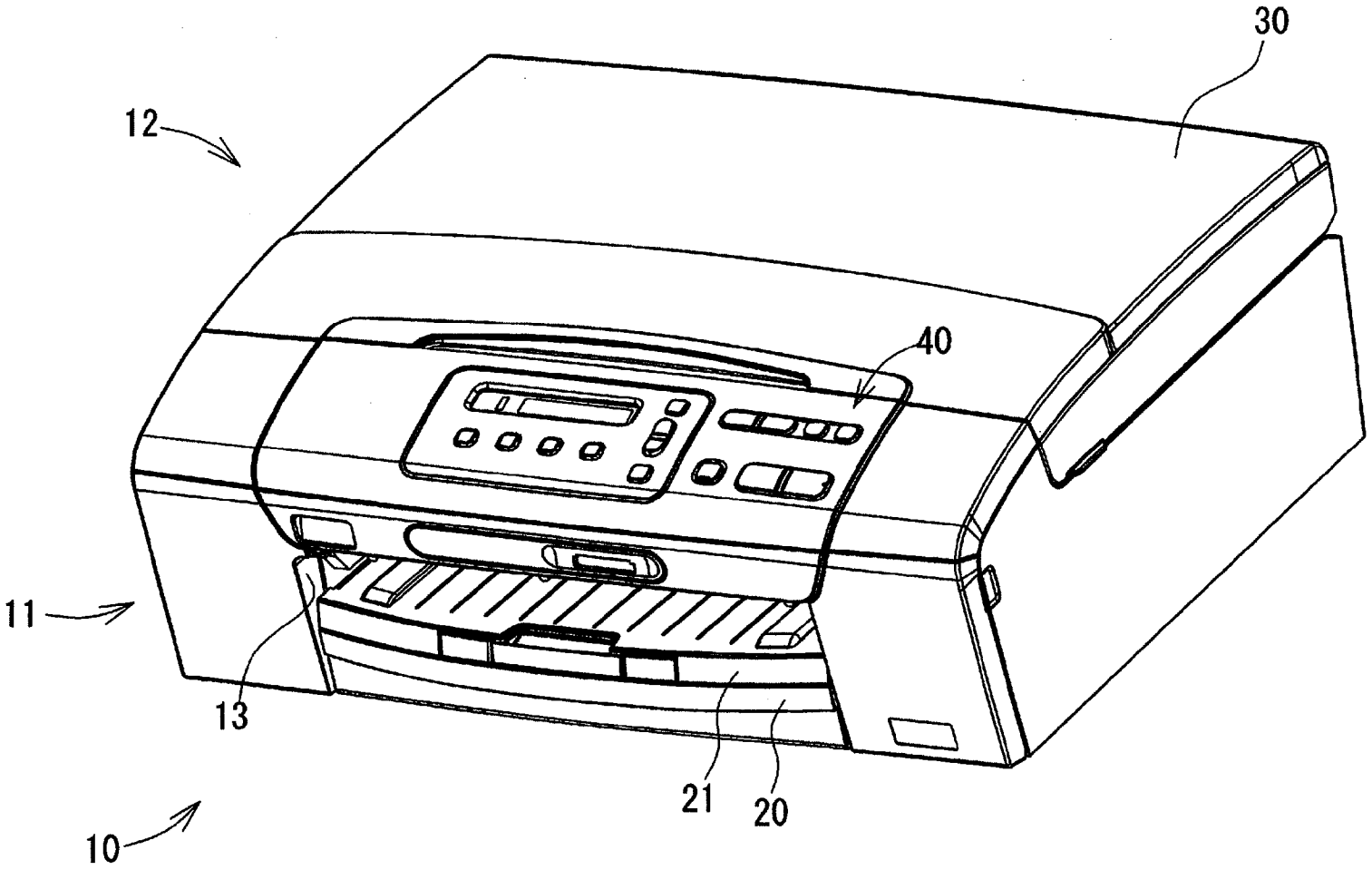
FIG. 1 is a perspective view of an image recording apparatus, e.g., a multi-function device, according to an embodiment of the invention.

As shown in FIG. 1, an image recording apparatus, e.g., a multi-function device 10 may perform one or more functions, e.g., printing, coping, scanning, facsimile functions, or any combination thereof. The image recording apparatus may perform single-sided recording and/or double-sided recording.

The multi-function device 10 comprises a printer 11 disposed at the bottom, a scanner 12 disposed at the top, and an operation panel 40 disposed at the front top of the device 10.

The printer 11 may record an image by inkjet method on a first side (front side) and a second side (back side) of a recording sheet. The printer 11 has an opening 13 at the front of the multi-function device 10. A feed tray 20 and a discharge tray 21 are arranged in two layers vertically in the opening 13. A recording medium, e.g., a sheet in the feed tray 20 is conveyed to the printer 11, and the sheet having an image recorded thereon is discharged onto the discharge tray 21. The feed tray 20 and the discharge tray 21 are detachably inserted into the printer 11 through the opening 13.

The scanner 12 may be a flatbed scanner. A document cover 30 is disposed at the top of the scanner 12 and serves as a top plate of the multi-function device 10. A platen glass (not shown) is disposed under the document cover 30. The scanner 12 reads a document placed on the platen glass and covered by the document cover 30.

The operation panel 40 for operating the printer 11 and the scanner 12 comprises operation buttons and a liquid crystal display. The operation panel 40 allows a user to perform various settings and operations, e.g., setting of the type of sheet (plain paper, postcard, etc.), the printing mode (single-sided mode or double-sided mode), and the resolution (draft mode or photo mode).

Figure 2:
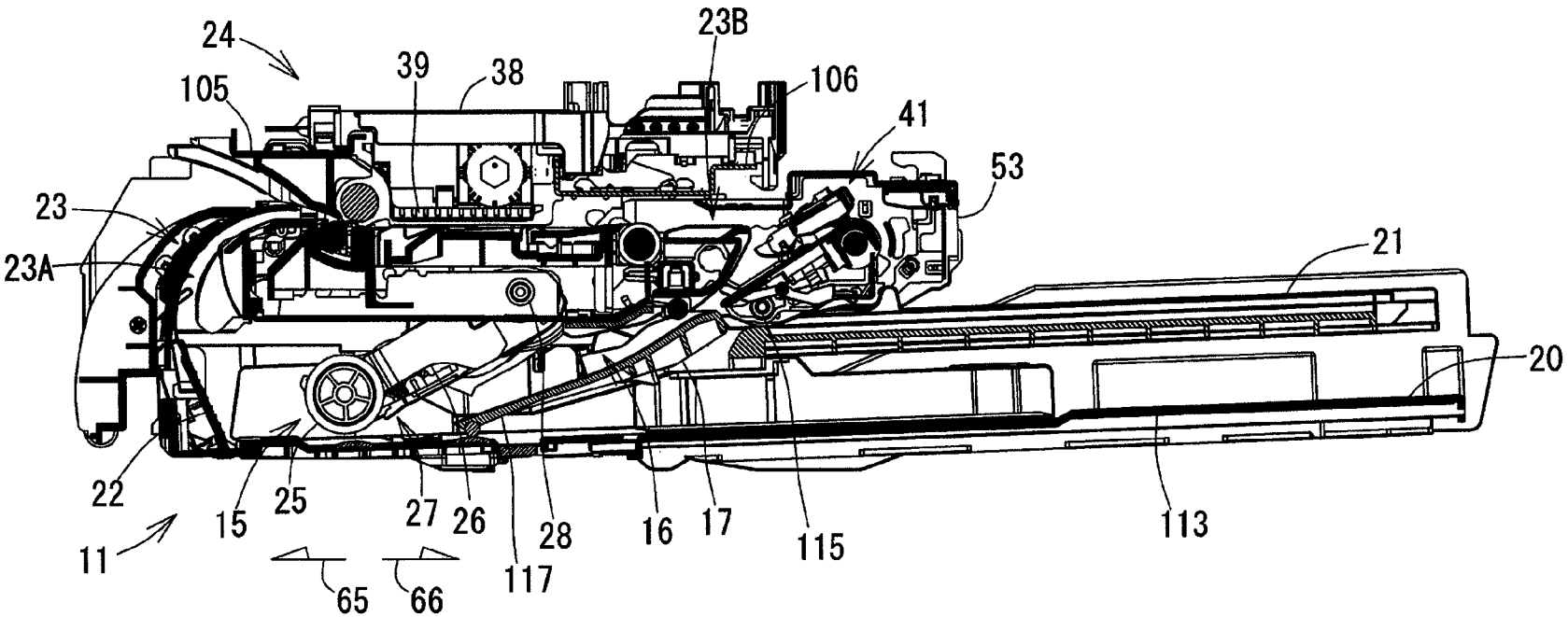
FIG. 2 is a vertical cross-sectional view of a printer according to an embodiment of the invention.

As shown in FIG. 2, the printer 11 comprises the feed tray 20, a sheet feeder 15, a recording unit 24, the discharge tray 21, and a path switching unit 41. The sheet fed by the sheet feeder 15 is conveyed along a first conveying path 23 to the recording unit 24. The sheet having an image recorded thereon is discharged onto the discharge tray 21. The path switching unit 41 is disposed between the recording unit 24 and the discharge tray 21 along the first conveying path 23, and is configured to selectively direct having an image recorded thereon to the discharge tray along the first conveying path 23 or back to the feed tray 20 along a second conveying path, e.g., a reverse path 16. The reverse path 16 is used for double-sided recording and is configured to guide the sheet toward the sheet feeder 15, which feeds the sheet again to the first conveying path 23.

Figure 4:
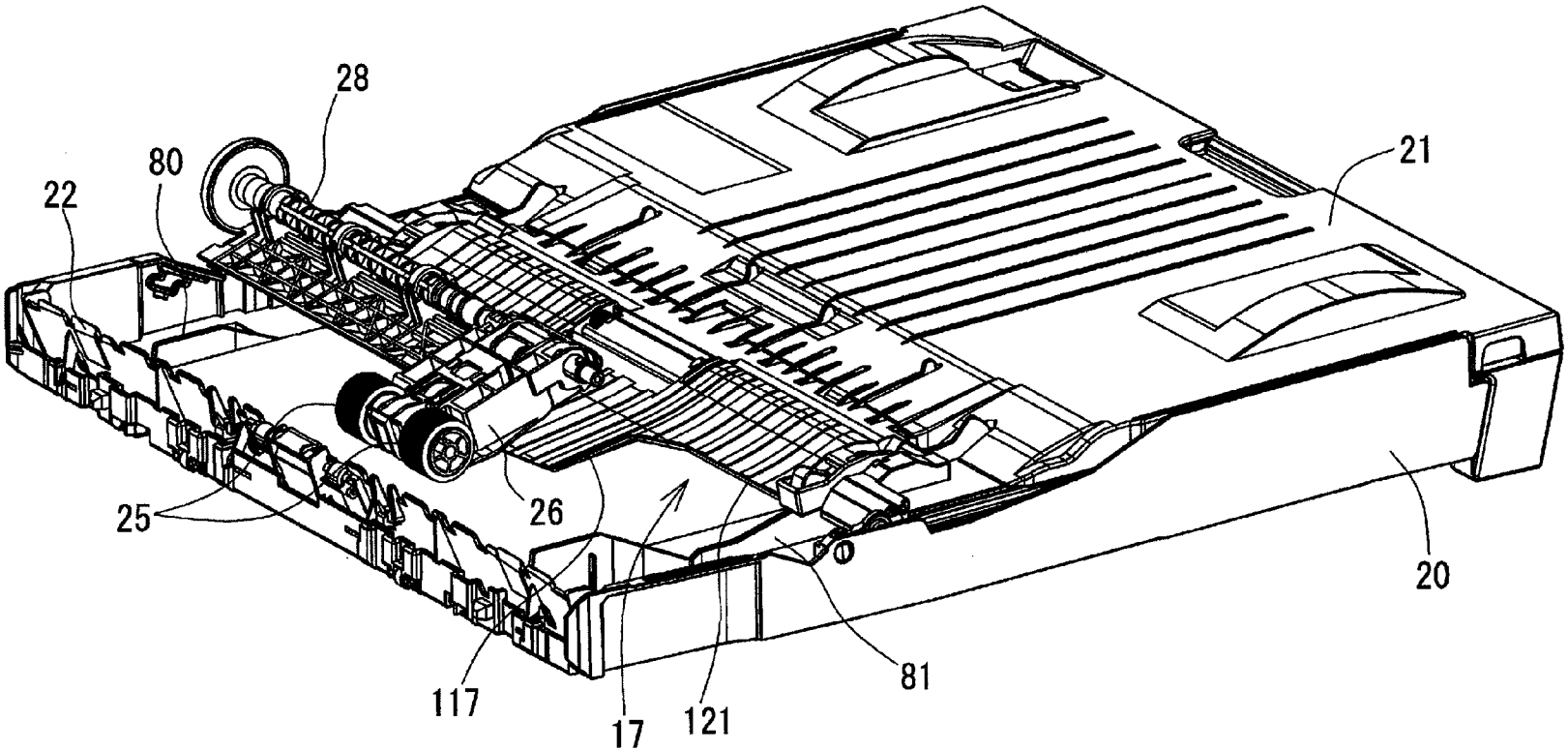
FIG. 4 is a perspective view of a feed tray in which sheets are stacked.
Figure 5:
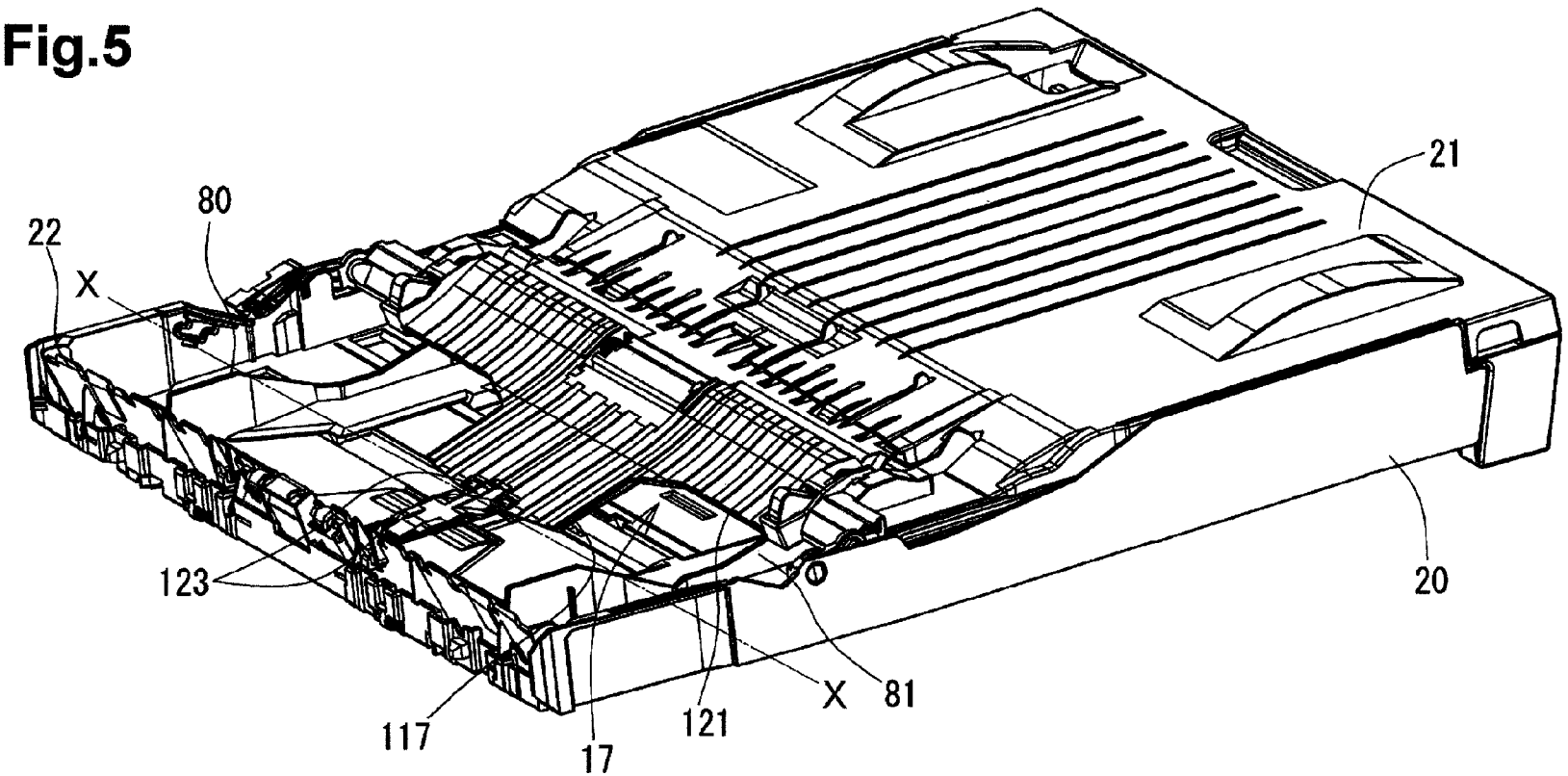
FIG. 5 is a perspective view of the feed tray of FIG. 4 in which no sheets are stacked.

The feed tray 20 is disposed under the sheet feeder 15 and at the bottom of the printer 11. As shown in FIGS. 4 and 5, the feed tray 20 is box-shaped and open upward, and comprises a bottom plate 113 for holding a stack of sheets. The sheet feeder 15 comprises a pair of feed rollers 25 configured to feed the sheets stacked on the feed tray 20 to the first conveying path 23.

A pair of side guides 80, 81 is disposed on the bottom plate 113. The side guides 80, 81 are made of a synthetic resin, e.g., an ABS resin, and has a substantially L-shaped horizontal section. The side guides 80, 81 are configured to slide in a widthwise direction of the feed tray 20, which is a direction perpendicular to the sheet plane of FIG. 3.

The side guides 80, 81 are configured to contact side edges of the sheets and to position the sheets in the feed tray 20 such that a widthwise center of the sheets coincides with a reference position, i.e., a widthwise center, of the feed tray 20. In other words, the sheets are center-registered with respect to the reference position of the feed tray 20. The sheets in the feed tray 20 are fed to a curved path 23A in a first direction 65 while being guided by the side guides 80, 81.

The discharge tray 21 is disposed on the feed tray 20 and at a front side of the multi-function device 10, i.e., a right side in FIG. 2. The discharge tray 21 serves as a cover that covers the front side of the feed tray 20 and prevents intrusion of dust or the like.

As shown in FIG. 4, a flap 17 is attached to one end, i.e., a left end in FIG. 2, of the discharge tray 21. The flap 17 is configured to contact and press the uppermost one of the sheets in the feed tray 20 and to suppress floating of the uppermost sheet which may curl due to moisture and temperature. The reverse path 16 comprises the flap 17 and guide members 34, 35.

Figure 3:
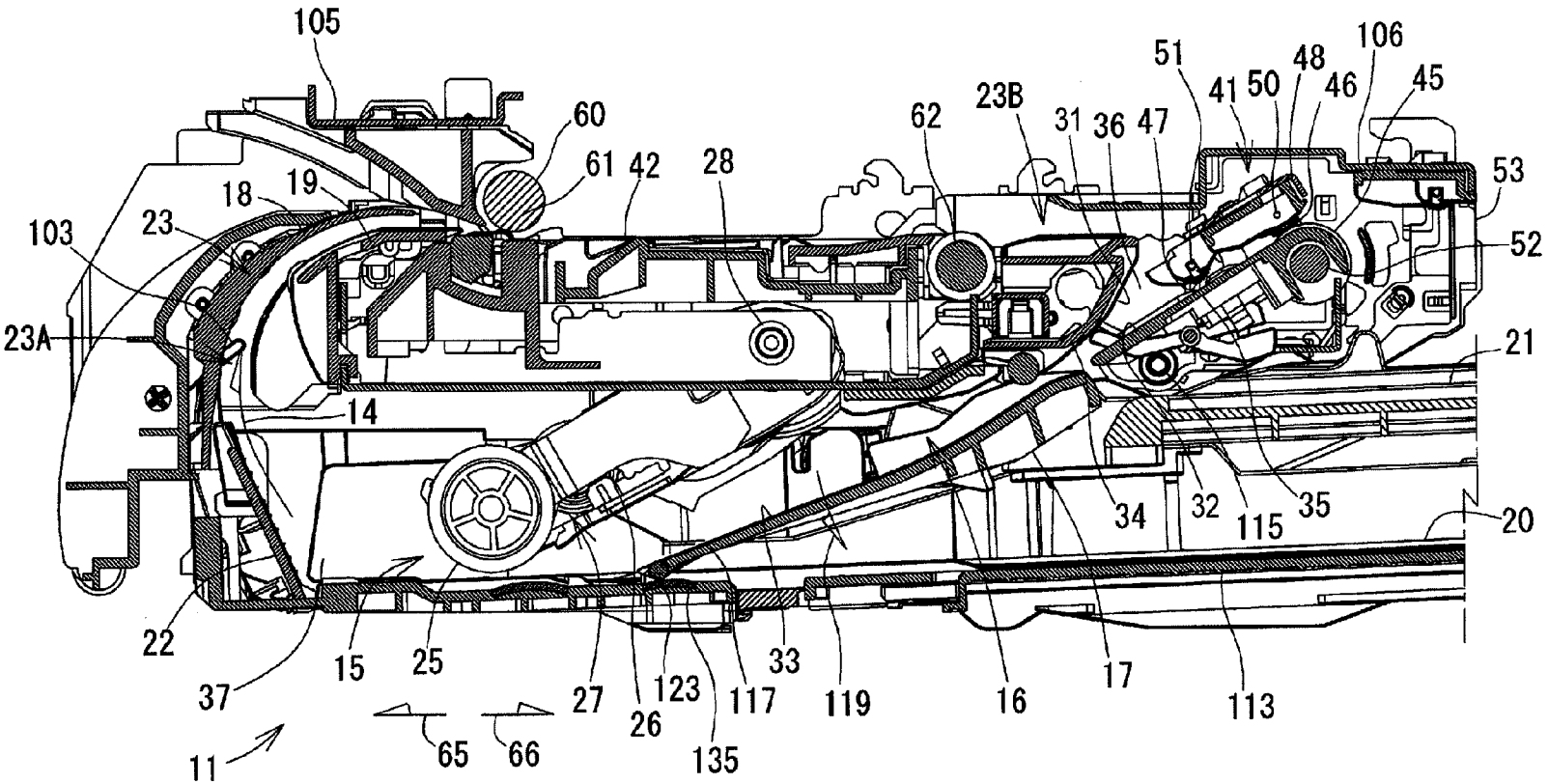
FIG. 3 is a partial enlarged vertical cross-sectional view of the printer of FIG. 2.

The structure of the printer 11 is now described in detail. As shown in FIG. 3, the sheet feeder 15 comprises the pair of feed rollers 25, a feed arm 26, and a drive transmission mechanism 27. The feed rollers 25 are positioned at a substantially widthwise center of the feed tray 20 and are configured to feed the sheets in the feed tray 20 to the first conveying path 23. The feed rollers 25 are supported rotatably at a distal end of the feed arm 26 and are rotated by a motor (not shown) via the transmission mechanism 27, e.g., gears arranged substantially linearly.

A rotary encoder (not shown) is attached to the feed rollers 25. The rotary encoder is configured such that an optical sensor detects a pattern of an encoder disc which rotates with the feed rollers 25. Based on a signal output by the optical sensor, a controller (not shown) of the multi-function device 10 controls the rotation of the feed rollers 25.

The feed arm 26 is supported, at its base end, on a shaft 28 so as to pivot about the shaft 28. The feed arm 26 moves vertically toward and away from the feed tray. The feed arm 26 is biased by its own weight or by a spring, or by both, to pivot downward. Thus, the feed rollers 25 contact the bottom plate 113 of the feed tray 20 when there is no sheet in the feed tray 20. The feed arm 26 is configured to move up away from the feed tray 20 when the feed tray 20 is inserted into and removed from the printer 11.

In order to feed the sheets from the feed tray 20, the feed rollers 25 rotate while pressing the sheets in the feed tray 20. An uppermost one of the sheets is fed to the first conveying path 23 in the first direction 65 (leftward in FIG. 3) due to friction generated between the feed roller 25 and the uppermost sheet.

When a leading edge of the uppermost sheet contacts a inclined separation plate 22 disposed on the feed tray 20, the uppermost sheet is guided upward in a direction indicated by arrow 14 and fed into the first conveying path 23. The inclined separation plate 22 prevents a sheet immediately under the uppermost sheet from being fed together due to friction and static electricity.

The first conveying path 23 comprises the curved path 23A extending from the inclined separation plate 22 to the recording unit 24, and a discharging path 23B extending from the recording unit 24 to the discharge tray 21. The curved path 23A extends from the feed rollers 25 and along the inclined separation plate 22 upward, then curves in the U-shape toward the front of the multi-function device 10 (rightward in FIG. 3), and reaches the recording unit 24. The feed rollers 25 feed the uppermost sheet from the feed tray 20 while contacting one side of the uppermost sheet, and the uppermost sheet is conveyed along the first conveying path 23 such that the other side of the uppermost sheet faces the recording unit 24. The discharging path 23B extends substantially linearly from the rear side to the front side of the multi-function device 20 and reaches the discharge tray 21.

The curved path 23 is defined, at the rear of the multi-function device 10, by an outer guide member 18 and an inner guide member 19. The outer guide member 18 and the inner guide member 19 are coupled to a main body frame 53 so as to oppose to each other with a predetermined interval left therebetween.

A convey roller 60 and a pinch roller 61 are disposed upstream of the recording unit 24 along the first conveying path 23. The pinch roller 61 press-contacts the convey roller 60 from below. The convey roller 60 and the pinch roller nip the sheet conveyed along the curved path 23A and conveys the sheet onto a platen 42.

A discharge roller 62 and a spur 63 are disposed downstream of the recording unit 24 along the first conveying path 23. The discharge roller 62 and the spur 63 nip the sheet having an image recorded thereon and conveyed the sheet further downstream toward the discharge tray 21.

The convey roller 60 and the discharge roller 62 are driven by a motor (not shown) synchronously. The controller (not shown) causes the motor to rotate in forward and reverse directions. The convey roller 60 and the discharge roller 62 are driven intermittently during image recording such that an image is recorded on the sheet while the sheet is conveyed by a predetermined line feed width.

A rotary encoder (not shown) is attached to the convey roller 60. The rotary encoder is configured such that an optical sensor detects a pattern of an encoder disc which rotates with the convey roller 60. Based on a signal output by the optical sensor, the controller controls the rotation of the convey roller 60 and the discharge roller 62. Before and after image recording, the convey roller 60 and the discharge roller 62 are driven continuously such that the sheet is conveyed at high speed.

A pivot member 103 is disposed upstream of the convey roller 60 on the curved path 23A. The pivot member 103 projects from the outer guide 18 into the curved path 23A so as to cross the curved path 23A. When the sheet conveyed along the curved path 23A contacts the pivot member 23, the pivot member 23 pivots and blocks an optical path of a photo-interrupter (not shown). Based on a signal from the photo-interrupter, the controller detects the position of the sheet being conveyed.

One end of the reverse path 16 is connected to the discharging path 23B and the other end thereof is connected to the feed tray 20. More specifically, the reverse path 16 starts from a downstream portion 36 located downstream of the recording unit 24, extends over the feed tray 20, and reaches an upstream portion 37 located at an entrance of the curved path 23 A. The entrance is adjacent to the inclined separation plate 22. The reverse path 16 guides the sheet having an image recorded on the front side (first side) thereof back to the feed tray 20.

The reverse path 16 is defined by a lower surface 31 of a guide member 34 and an upper surface 32 of a guide member 35 and an upper surface 33 of the flap 17. The guide member 34 and the guide member 35 are disposed inside the main body frame 53. The guide member 34 is opposed to the guide member 35 and the flap 17 with a predetermined interval left therebetween. The lower surface 31 and the upper surfaces 32, 33 extend obliquely, with respect to the bottom plate 113, from the downstream portion 36 toward the feed rollers 25.

According to another embodiment of the invention, the reverse path 16 may extend differently as long as the reverse path 16 connects the downstream portion 36 to the upstream portion 37 such that the sheet is conveyed back to the upstream portion 37.

The path switching unit 41 is disposed downstream of the recording unit 24 in the first conveying path 23, and adjacent to a connecting portion between the discharging path 23B and the reverse path 16. The path switching unit 41 comprises first rollers 45 and second rollers 46 which pair up respectively, and auxiliary rollers 47 disposed in parallel with the second rollers 46.

The roller pairs 45, 46 nip the sheet conveyed from the discharge roller 62 and the spur 63, and conveys the sheet further downstream along the discharging path 23B or conveys the sheet along the reverse path 16.

The second rollers 46 and the auxiliary rollers 47 are mounted to a frame 48. The frame 48 extends in a widthwise direction of the multi-function device 10, i.e., a direction perpendicular to the sheet plane of FIG. 3. The frame 48 is bent into an L shape in vertical cross section to have necessary rigidity.

The second rollers 46 and the auxiliary rollers 47 are disposed at predetermined intervals in the widthwise direction of the multi-function device 10, and are supported rotatably on a shaft 50 and a shaft 51, respectively. The second rollers 46 and the auxiliary rollers 47 may have a spur shape, similar to the spur shape of the spur 63. The auxiliary rollers 47 are disposed upstream, by a predetermined distance, of the second rollers 46 in the discharging path 23B. The second rollers 46 are biased toward the first rollers 45 by an elastic member.

The first rollers 45 are driven by a motor (not shown) via a predetermined transmission mechanism. The first rollers 45 have a center shaft 52 that is supported by the main body frame 53 of the multi-function device 10.

The second rollers 46 are placed on the first rollers 45. A single, elongated, cylindrical roller may be used, instead of the first rollers 45. The first rollers 45 are driven by the motor (not shown) to rotate forwardly or reversely. The sheet conveyed from the recording unit 24 along the discharging path 23B is nipped by the first rollers 45 and the second rollers 46.

Figure 6:
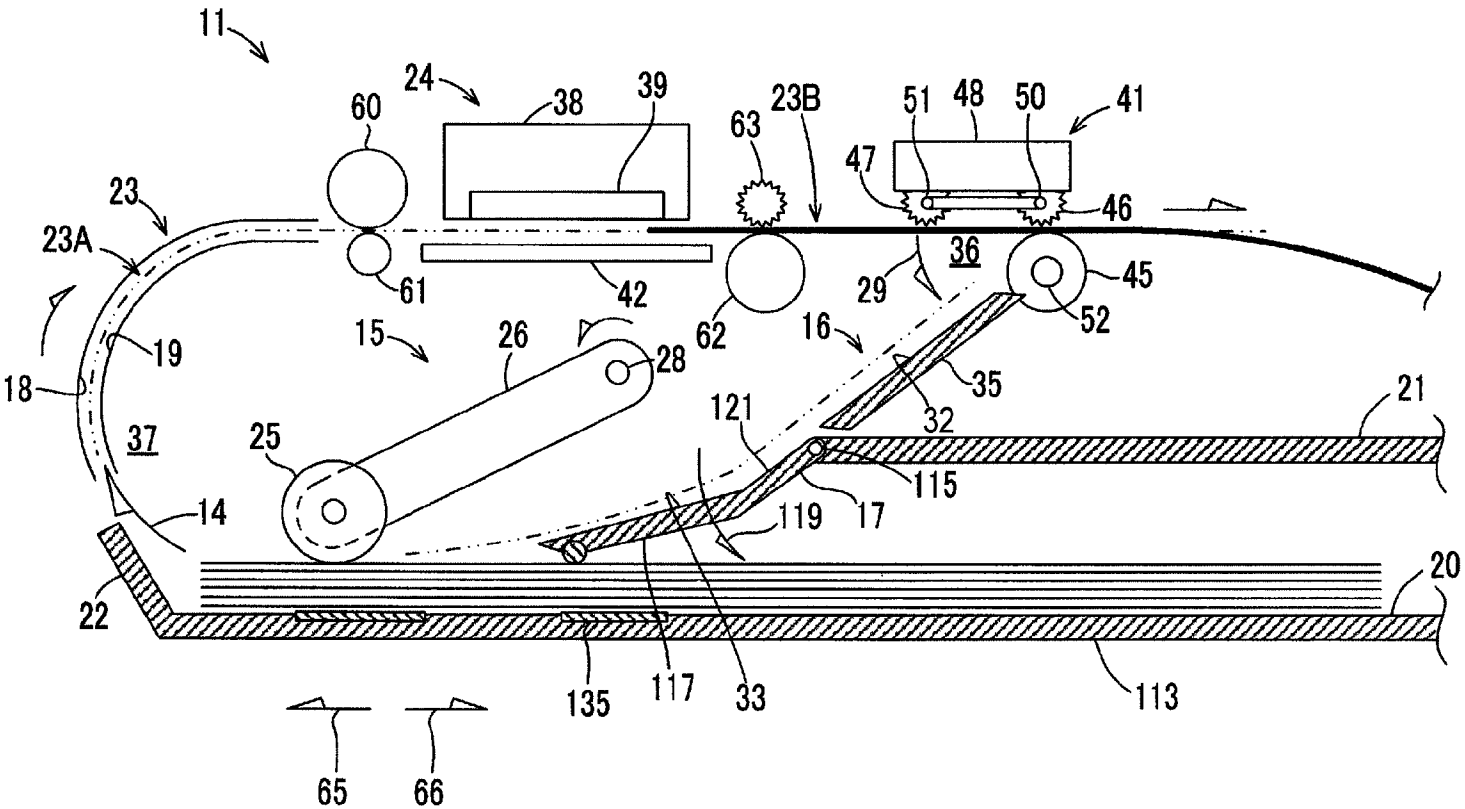
FIG. 6 is a schematic view illustrating the structure and operation of a path switching unit according to an embodiment of the invention.
Figure 7:
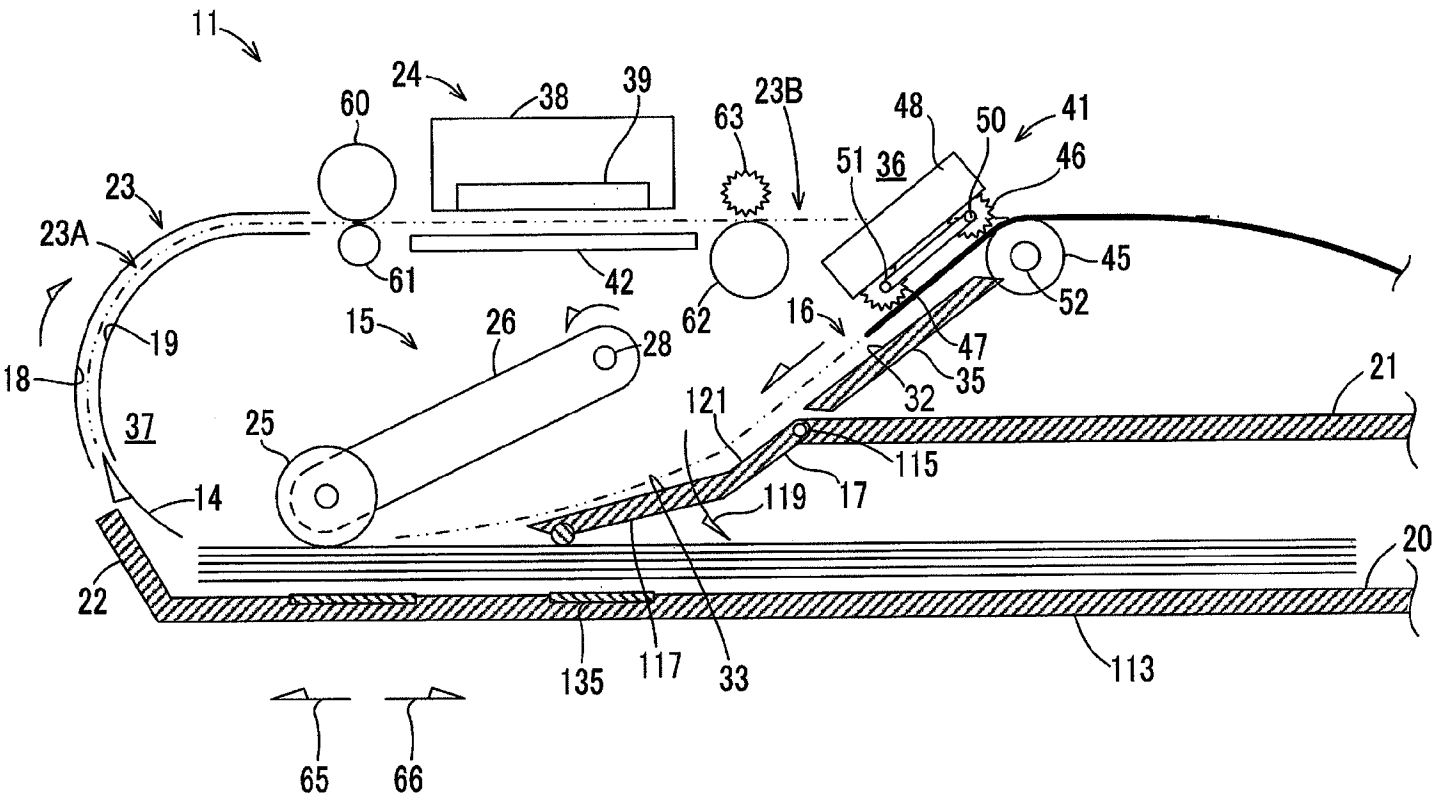
FIG. 7 is a schematic view illustrating the structure and operation of the path switching unit of FIG. 6.

As shown in FIGS. 6 and 7, the path switching unit 41 is configured such that the frame 48, the second rollers 46, and the auxiliary rollers 47 pivot, as a single body, about the center shaft 52 in a direction of arrow 29. The path switching unit 41 changes its position toward the direction of arrow 29 depending on whether or not a driving force is transmitted thereto from the motor (not shown). More specifically, the path switching unit 41 changes between a discharging position and a reversing position. In the discharging position, as shown in FIG. 6, the path switching unit 41 discharges the sheet having passed the recording unit 24 toward the discharge tray 21. In the reversing position, as shown in FIG. 7, the path switching unit 41 guides the sheet having passed the recording unit 24 in a reverse direction toward the reverse path 16.

When the first rollers 45 rotate forwardly, e.g., clockwise in FIGS. 6 and 7, the path switching unit 41 remains in the discharging position such that the sheet having passed the recording unit 24 is conveyed toward the discharge tray 21, i.e., rightward in FIG. 6. In a single-sided recording mode, the sheet fed by the feed rollers 25 is guided along the first conveying path 23 upward so as to make a U-turn toward the recording unit 24, where an image is recorded on the first side (front side) of the sheet. Then, when the first rollers 45 rotate forwardly, the sheet discharged from the recording unit 24 is conveyed downward while being nipped by the first rollers 45 and the second rollers 46 and is discharged onto the discharge tray 21.

In a double-sided recording mode, after the sheet discharged from the recording unit 24 reaches the path switching unit 41, a trailing edge of the sheet is nipped by the first rollers 45 and the second rollers 46. In this state, when the rotation direction of the motor is changed, the rotation direction of the first rollers 45 is changed from forward to reverse (counter-clockwise in FIGS. 6 and 7), and the path switching unit 45 is changed from the discharging position to the reversing position. The auxiliary rollers 47 press the trailing edge of the sheet and direct the tailing edge toward the reverse path 16. The first rollers 45 and the second rollers 46 convey the sheet in the reverse direction with the trailing edge as a leading edge. Then, the feed roller 35 feeds the sheet to the first conveying path 23 again. After the recording unit 24 records an image on the second side (back side) of the sheet, the sheet is discharged onto the discharge tray 21.

In this embodiment, the driving force of the motor (not shown) is transmitted to the feed rollers 25 via the pivot shaft 28 when the first rollers 45 rotate forwardly, and driving force is not transmitted to the feed rollers 25 when the first rollers 45 rotate reversely. In other words, the driving force is not transmitted to the pivot shaft 28 when the first rollers 45 convey the sheet along the reverse path 16. This operation is done by controlling the motor for driving the feed rollers 25 independently of the motor for driving the first rollers 45. In another embodiment of the invention, the above operation may be done by using a transmission switching member, e.g., a clutch and a planet gear, for a transmission system where the feed rollers 25, the convey roller 62, and the first rollers 45 are driven by a single common motor.

Either in the single-sided recording and the double-sided recording, a so-called reverse registration may be performed to correct skewing of the sheet before the sheet reaches the recording unit 24. According to an embodiment of the invention, when the leading edge of the sheet fed to the curved path 23A in the first direction 65 reaches the convey roller 60 and the pinch roller 61 and is pinched by these rollers 60, 61, the convey roller 60 is rotated reversely such that the sheet is conveyed, along the curved path 23A, back to the feed tray 20 in a second direction 66 opposite to the first direction 65. The leading edge of the sheet is pressed against the nip portion between the convey roller 60 and the pinch roller 61 by friction between the sheet being conveyed back along the curved path 23A and the outer guide 18 and by repulsion of the sheet being bent. As a result, the leading edge is aligned with respect to the nip portion.

As shown in FIG. 3, the flap 17 is disposed on the feed tray 20. The flap 17 defines a part of the reverse path 16 and serves as a pressing member that contacts and presses downward the uppermost one of the sheets stacked in the feed tray 20. The flap 17 comprises a flap body 121 and a pair of rollers 123.

The flap body 121 extends obliquely with respect to the bottom plate 113 of the feed tray 20 such that a downstream end of the flap body 121 is below an upstream end of the flap body 121 in the first direction 65. More specifically, the flap body 121 extends from an end of the discharge tray 21 toward the feed rollers 25. The flap body 121 comprises a shaft 115 that is supported at the end of the discharge tray 21 such that the flap body 121 pivots about the shaft 115.

The flap body 121 comprises a projecting portion 117. The projecting portion 117 projects obliquely downward from a widthwise central portion of the flap body 121 toward a bottom plate 113 of the feed tray 20. A widthwise center of the projecting portion 117 coincides with the reference position of the center-registered side guides 80, 81, i.e., the widthwise center of the feed tray 20. An end portion 118 of the projecting portion 117 is positioned upstream of the feed rollers 25 in the first direction 65, and is positioned in close proximity of the feed rollers 25. The flap 113 is urged toward the bottom plate 113 of the feed tray 20 in a direction of arrow 119 (FIG. 3) by a coil spring or the like provided on the shaft 115.

Figure 9:
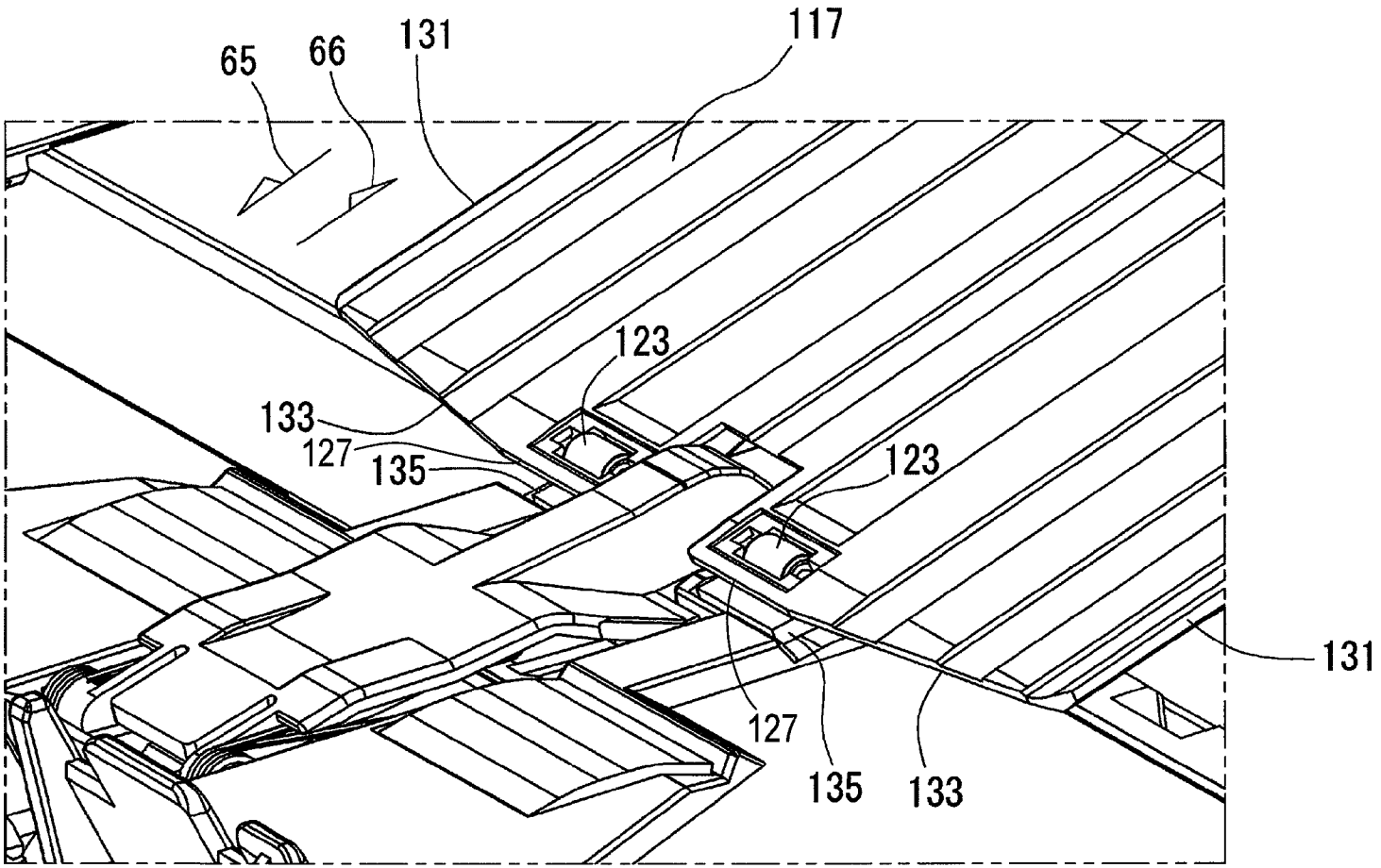
FIG. 9 is an enlarged perspective view of the distal end of the flap of FIG. 8.

As shown in FIG. 9, the rollers 123 are attached adjacent to a downstream end of the end portion 118 in the first direction 65 and are arranged at intervals in the widthwise direction of the feed tray 20 which is perpendicular to the first direction 65. The rollers 123 are positioned at the substantially widthwise center of the sheet feed tray 20. The rollers 123 are positioned upstream of the feed rollers 25 in the first direction 65, and are positioned in close proximity of the feed rollers 25. The rollers 123 are supported rotatably by the projecting portion 117. The rollers 123 may be made of a synthetic resin, e.g., a polyacetal (POM) resin.

Each of the rollers 123 is supported by the end portion 118 such that a roller surface of the roller 123 projects downward from a lower surface 125 of the projecting portion 117. The lower surface 125 faces the bottom plate 113 of the feed tray 20 or an upper surface of the sheets stacked in the feed tray 20. The rollers 123 contact the bottom plate 113 or the upper surface of the sheets in the feed tray 20. A position where the rollers 123 contact the uppermost sheet in the feed tray 20 is upstream, in the first direction 65, of a position where the feed rollers 25 contact the uppermost sheet. The flap 17 applies, via the rollers 123, a downward pressing force to the sheets in the feed tray 20, thereby to suppress floating and skewing of the sheet being fed from the feed tray 20. Because the rollers 123 are rotated by the sheet being fed by the feed rollers 25, a load applied by the flap 17 is reduced.

When the flap 17 presses the sheets, friction between two adjacent sheets increase. This may cause feeding of two or more sheets at the same time. To prevent such erroneous feeding, high-friction members 135, e.g., cork plates, which have a higher friction coefficient than the bottom plate 113, are placed on the bottom plate 113. The high-friction members 135 are disposed at positions where the downward pressing force is applied by the rollers 123. The pressing force increases friction between the sheets and the bottom plate 113, and the increased friction retains the sheets on the bottom plate 113. Even when the sheets receive the pressing force from the rollers 123, erroneous sheet feeding is unlikely to occur. Especially, feeding of two or more sheets is prevented effectively when a small number of sheets remain in the feed tray 20.

The roller surface of each of the rollers 123 does not project upward from an upper surface of the projecting portion 117, i.e., the upper surface 33 of the flap 17 which defines a part of the reverse path 16. Thus, the sheet guided along the reverse path 16 is conveyed smoothly toward the feed rollers 25 without being interfered by the rollers 123.

Figure 8:
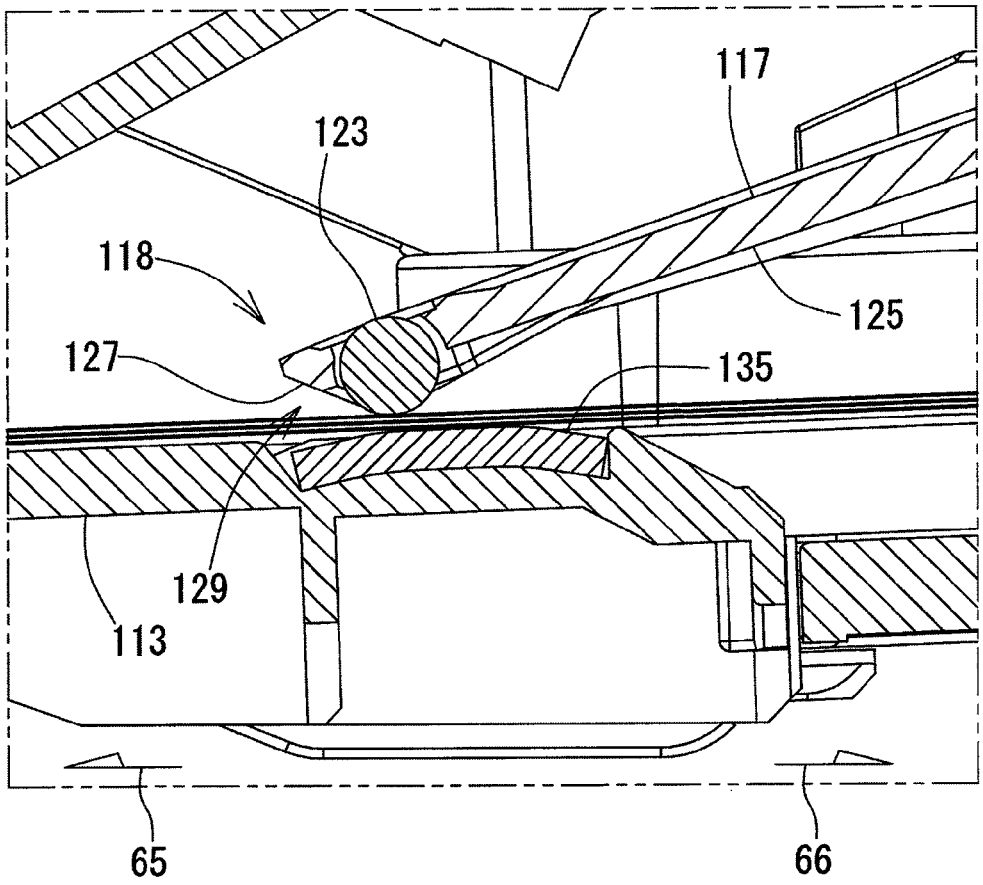
FIG. 8 is an enlarged vertical cross-sectional view of a distal end of a flap according to an embodiment of the invention.

The end portion 118 of the projecting portion 117 comprises a pair of first guides, e.g., a pair of guide surfaces 127, each extending from a lower surface 125 of the projecting portion 117 to the upper surface 33 of the flap 17. As shown in FIG. 8, each of the guide surfaces 127 extends obliquely with respect to the bottom plate 113 or an upper surface of the sheets in the feed tray 20 when the roller 123 is in contact with the upper surface of the sheets. The guide surface 127 extends between a downstream end of the projecting portion 117 and a corresponding one of the rollers 123 such that a distance between the bottom plate 113 and the guide surface 127 increases along the first direction 65. Thus, a space 129 tapered along the second direction 66 is created between the guide surface 127 and the bottom plate 113 or the upper surface of the sheets in the feed tray 20.

Figure 10A:
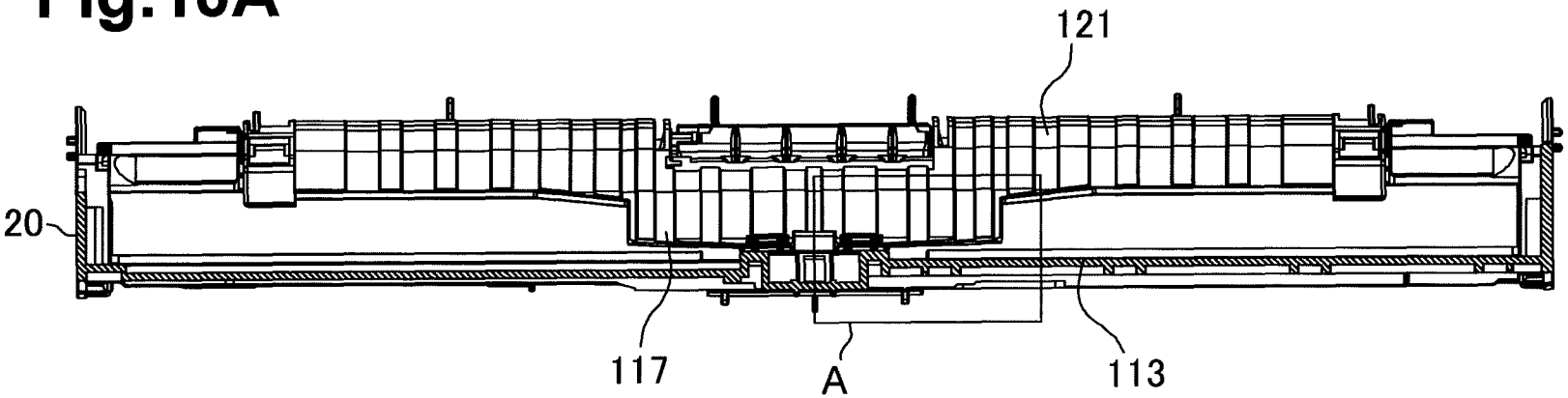
FIG. 10A is a vertical cross-sectional view of the feed tray taken along line X-X of FIG. 5, with side guides of the feed tray omitted from the view.
Figure 10B:
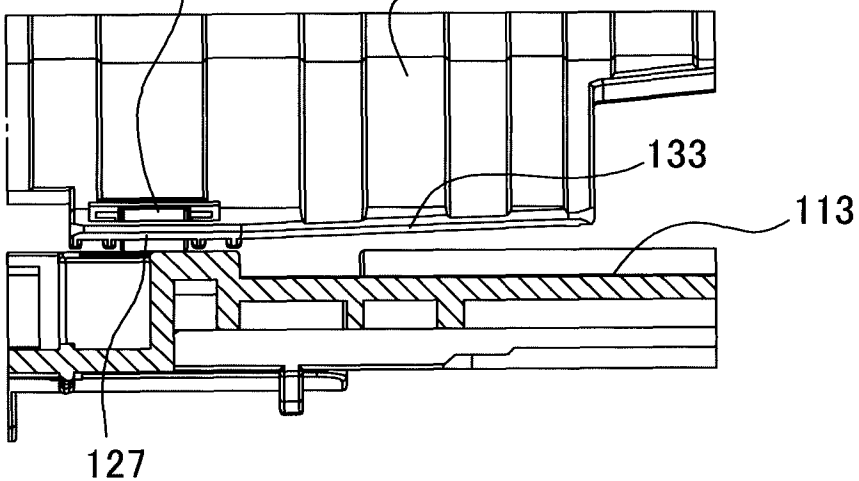
FIG. 10B is an enlarged view of an enclosed portion A of FIG. 10A.
Figure 11A:
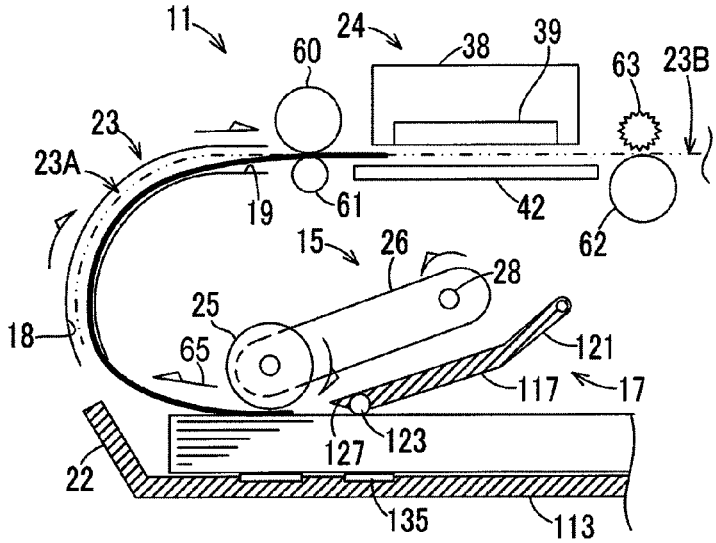
FIGS. 11A-11C are schematic views illustrating the printer of FIG. 2 in which a sheet is conveyed back to a feed tray, according to an embodiment of the invention.
Figure 11B:
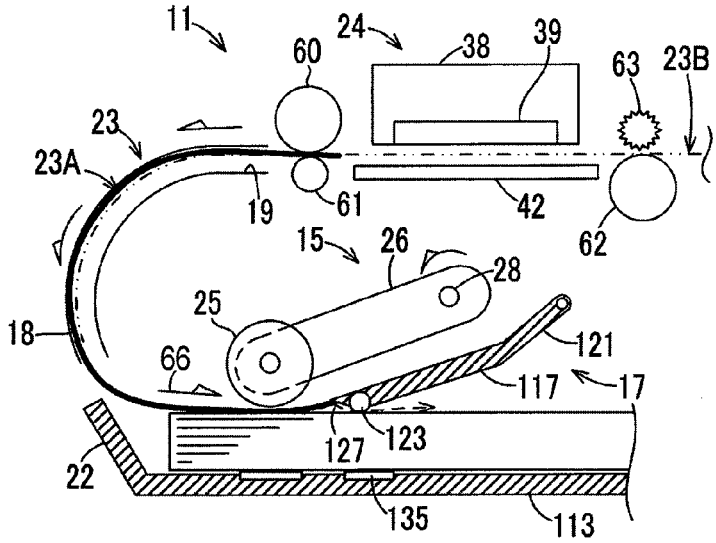
Figure 11C:
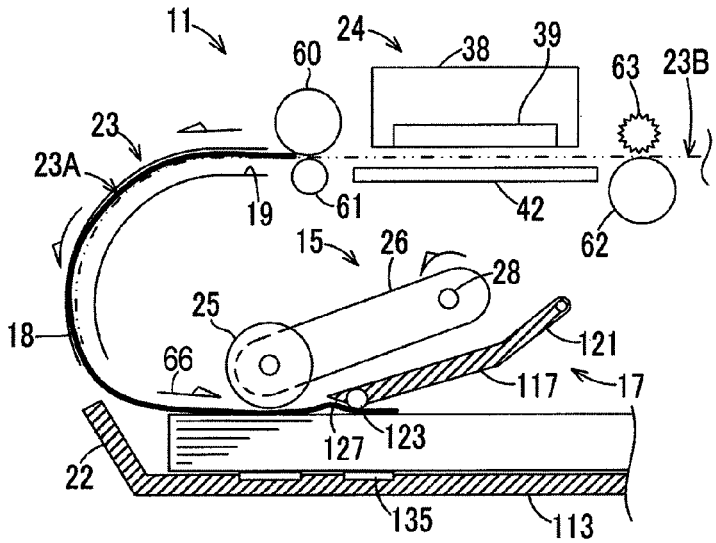

As shown in FIG. 9, the end portion 118 further comprises a pair of second guides, e.g., a pair of oblique guides 133. Each oblique guide 133 extends between a corresponding one of the guide surfaces 127 and a corresponding one of side edges 131 of the projecting portion 117. Each oblique guide 133 is positioned outside the corresponding guide surface 127 in the widthwise direction of the feed tray 20 and comprises a central portion and an outside portion which is positioned beyond the central portion in the feed tray widthwise direction. The oblique guide 133 extends such that the outside portion is more recessed than the central portion in the second direction 66. As shown in FIGS. 10A and 10B, the oblique guide 133 extends such that a distance between the bottom plate 113 and the oblique guide 133 increases from the central portion to the outside portion. As best shown in FIG. 10B, the oblique guide 133 comprises a convex surface which faces the bottom plate 113. By way of example, a distance between the bottom plate 113 and a central side end of the oblique guide 133 may be 0.8 mm, and a distance between the bottom plate 113 and an outside end the oblique guide 133 may be 1.65 mm.

FIGS. 10A-10C illustrate reverse conveyance of a sheet in the above-described printer 11, performed for the purpose of sheet registration or other reasons. As shown in FIG. 10A, a sheet is fed by the feed rollers 25 in the first direction 1 to the curved path 23A of the first conveying path 23 and reaches the convey roller 60 and the pinch roller 61. A leading edge of the sheet is nipped between the convey roller 60 and the pinch roller 61. At this time, a trailing edge of the sheet may be released from the rollers 123 if the sheet is A6, 4×6 inches in size or the like that are smaller than a predetermined size, e.g., A4.

Then, as shown in FIG. 10B, the convey roller 60 is rotated reversely, and the sheet is conveyed, along the curved path 23A, back to the feed tray 20 in the second direction 66 opposite to the first direction 65. When the convey roller 60 is rotated reversely, the feed rollers 25 may be disconnected from the driving force and may be rotatable by the sheet conveyed in the second direction 66. The trailing edge released from the rollers 123, which is the leading edge with respect to the second direction 66, abuts the guide surfaces 127 and is guided along the guide surfaces 127 toward the rollers 123. Then, as shown in FIG. 10C, the trailing edge guided along the guide surfaces 127 abuts the rollers and enters a lower side of the flap 17 while rotating the rollers 123.

Even when the sheet is curled up at widthwise side edges, the feed rollers 25 press down the trailing edge of the sheet (leading edge of the sheet with respect to the second direction 66) and suppress the curl such that the trailing edge is guided along the guide surfaces 127. Further, the oblique guides 133 press down the curled portions of the trailing edge, other than the portions guided by the guide surfaces 127, and guide the curled portions smoothly to a lower side of the flap 17. Accordingly, when the sheet is conveyed back to the feed tray 20, a collision between the trailing edge and the flap 17 is unlikely to occur. This minimizes skewing or jamming of the sheet, or damage to the sheet due to an interruption of the reverse conveyance of the sheet.

According to the above-described embodiment of the invention, the rollers 123 are disposed at the end portion 118. Because rolling friction is less than sliding friction, load applied by the rollers 123 to the sheet conveyed under the rollers 123 are less than the case without the rollers 123. Thus, the rollers 123 facilitate the sheet conveyed back to the feed tray 20 to enter the lower side of the flap 17. However, the rollers 123 may be omitted, and the end portion 118 may be configured such that a lower surface thereof directly contacts the sheet.

According to another embodiment of the invention, the printer 11 may not have a both-sided recording mode and may have a single-sided recording mode only.

In a single-sided printer, the path switching unit 41 may be omitted, and the flap 71 is not required to define the reverse path 16. The flap 17 serving as a sheet pressing member may be configured to extend from an end of the discharge tray 21 toward the feed tray 20 vertically, instead of obliquely. In this case, the flap 71 may be configured such that a contact position of the flap 17 with the upper surface of the sheets varies depending on the number of remaining sheets in the feed tray 20. Alternatively, the flap 17 may be configured to extend from an end of the discharge tray 21 horizontally, parallel to the bottom plate 113 of the feed tray 20. In either case, by implementing the guide surfaces 127 and the oblique guides 133 at the extending end of the flap 17 according to the above-described embodiment, a sheet conveyed in the reverse direction toward the feed tray 20 may be guided smoothly to the lower side of the flap 17.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording apparatus comprising:

a sheet conveying device comprising:

a feed tray comprising a bottom plate configured to hold a sheet;

a feed roller configured to feed the sheet in a first direction from the feed tray to a first conveying path; and a pressing member configured to press the sheet in the feed tray against the bottom plate of the feed tray, the pressing member comprising:

a contact portion configured to contact the sheet in the feed tray; and a first guide positioned at a downstream end of the pressing member in the first direction and extending obliquely with respect to the bottom plate between the downstream end and the contact portion, such that a distance between the bottom plate and the first guide increases along the first direction, wherein the first guide is positioned upstream of the feed roller in the first direction; and a recording unit disposed along the first conveying path and configured to record an image onto the sheet being conveyed along the first conveying path, wherein the sheet conveying device is configured to convey the sheet along a second conveying path back to the feed tray after the sheet passes the recording unit, wherein the pressing member further comprises a guiding surface that defines a part of the second conveying path and is configured to guide the sheet back to the feed tray, and wherein the contact portion and the first guide of the pressing member face the bottom plate of the feed tray, and the guiding surface of the pressing member faces away from the bottom plate.

2. The image recording apparatus according to claim 1, wherein the pressing member further comprises a second guide positioned outside the first guide in a feed tray widthwise direction, the feed tray widthwise direction is perpendicular to the first direction, the second guide comprises a central portion and an outside portion, the outside portion is positioned beyond the central portion in the feed tray widthwise direction, and the second guide extends, such that a distance between the bottom plate and the second guide increases from the central portion to the outside portion.

3. The image recording apparatus according to claim 2, wherein the second guide comprises a convex surface which faces the bottom plate.

4. The image recording apparatus according to claim 1, wherein the pressing member further comprises a second guide positioned outside the first guide in a feed tray widthwise direction, the feed tray widthwise direction is perpendicular to the first direction, the second guide comprises a central portion and an outside portion, the outside portion is positioned beyond the central portion in the feed tray widthwise direction, and the second guide extends, such that the outside portion is more recessed than the central portion in a second direction opposite to the first direction.

5. The image recording apparatus according to claim 4, wherein the second guide comprises a convex surface which faces the bottom plate.

6. The image recording apparatus according to claim 1, further comprising a convey roller configured to convey the sheet, along the first conveying path, back to the feed tray in a second direction opposite to the first direction, wherein the first guide is configured to guide the sheet conveyed in the second direction to the contact portion.

7. The image recording apparatus according to claim 1, wherein the pressing member extends obliquely with respect to the bottom plate of the feed tray, such that the downstream end of the pressing member is below an upstream end of the pressing member in the first direction.

8. The image recording apparatus according to claim 1, wherein the contact portion of the pressing member comprises a rotary body that is rotatably supported at the downstream end of the pressing member.

9. The image recording apparatus according to claim 1, wherein a first position where the contact portion is configured to contact the sheet in the feed tray is upstream, in the first direction, of a second position where the feed roller is configured to contact the sheet in the feed tray.

10. The image recording apparatus according to claim 9, wherein the feed roller and the contact portion are positioned at substantially a center of the feed tray in a feed tray widthwise direction, and the feed tray widthwise direction is perpendicular to the first direction.

11. The image recording apparatus according to claim 1, further comprising a cover configured to partially cover an upper opening of the feed tray, wherein the pressing member is supported pivotably at an end of the cover.

12. The image recording apparatus according to claim 1, further comprising:

a discharge tray disposed along the first conveying path and configured to receive the sheet after the sheet passes the recording unit, and a path switching unit disposed between the recording unit and the discharge tray along the first conveying path and configured to selectively direct the sheet to one of the discharge tray and the feed tray along one of the first conveying path and the second conveying path, respectively, wherein the pressing member is configured to pivot about an end of the discharge tray.

* * * * *